US005799942A

United States Patent [19]

Birt

[11] Patent Number: 5,799,942

[45] Date of Patent: Sep. 1, 1998

[54] METHOD OF PLAYING BOARD GAME

[76] Inventor: Frances B. Birt, 11701 Lemoli Ave., Inglewood, Calif. 90303

[21] Appl. No.: 898,358

[22] Filed: Jul. 22, 1997

[51] Int. Cl.[6] ..... A63F 3/00

[52] U.S. Cl. ..... 273/256

[58] Field of Search ..... 273/242, 243, 273/256, 278

[56] References Cited

U.S. PATENT DOCUMENTS

| | | | |
|---|---|---|---|
| 3,565,437 | 2/1971 | Mitchell | 273/256 |
| 4,279,422 | 7/1981 | Shaw | 273/256 |
| 4,480,838 | 11/1984 | Aharonian | 273/256 |
| 4,991,853 | 2/1991 | Lott | 273/278 X |
| 5,190,292 | 3/1993 | Perry | 273/256 |
| 5,439,229 | 8/1995 | Kaiser | 273/256 |
| 5,673,915 | 10/1997 | Shalders | 273/256 |

*Primary Examiner*—William E. Stoll
*Attorney, Agent, or Firm*—Irving Keschner

[57] ABSTRACT

A board game comprising a game board, games pieces, dice, score cards, score sheets, and play money. At the beginning of the game, each player will receive a check list, along with two twenty dollar bills, three ten dollar bills, three five dollar bills, four two dollar bills, and seven one dollar bills. The dice will then be rolled to determine the order of play. Players cannot swap, trade, or borrow monies or properties during game play; a player will not be allowed to purchase or sell to the student store. One trip around the board, during play, is representative of a year, and will be broken down into twelve months, and will include properties, bills and expenses to be paid, and income to be made. A player may not purchase any properties unless he or she lands upon the appropriate space. More than one player may occupy a space at once. Players may not purchase any properties the first time around the board; however, all expenses must be paid, at any time during the game. Each time a player passes the starting point, he or she will receive $100.00 allowance. Months will be sold for less than the purchase price, and weekdays are to be sold for less than the purchase price. If during play, a player lands upon an "Event Card" space, that player must draw a card, and follow directions given. If a player rolls doubles, he or she may move, and then roll the dice again. The game continues until a player purchases all twelve months and all seven days, and becomes the winner.

5 Claims, 3 Drawing Sheets

FIG. 1
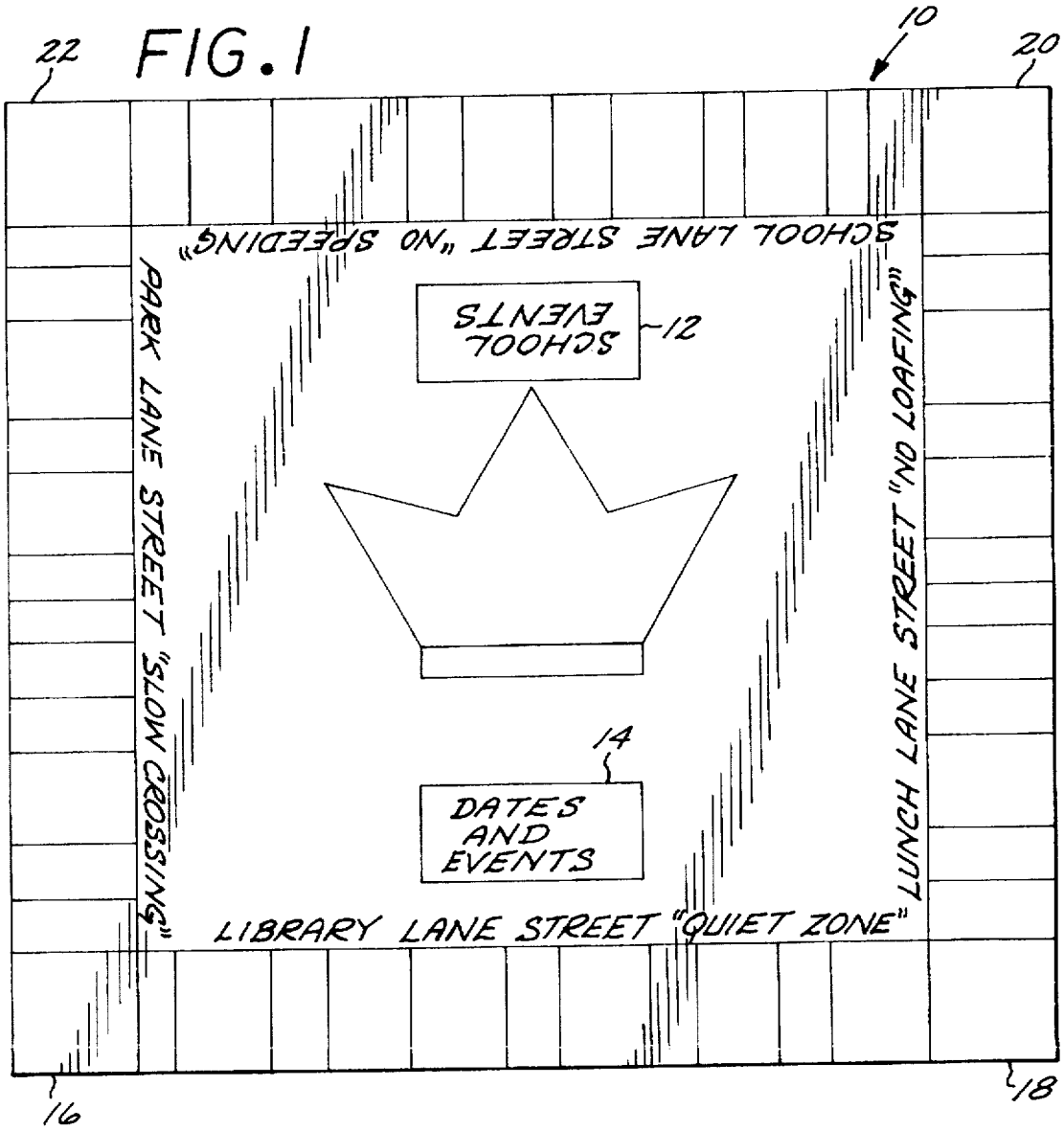
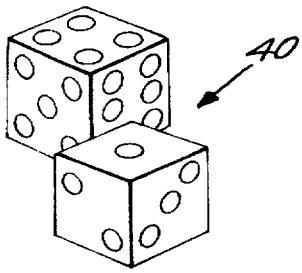
FIG. 3
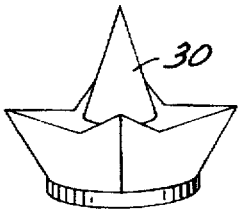
FIG. 2

100

| CHECK LIST | | | OWN | SOLD | OWN | SOLD | OWN |
|---|---|---|---|---|---|---|---|
| JAN. | $50. | ○ | | | | | |
| FEB. | $50. | ○ | | | | | |
| MAR. | $40. | ○ | | | | | |
| APR. | $40. | ○ | | | | | |
| MAY | $50. | ○ | | | | | |
| JUNE | $40. | ○ | | | | | |
| JULY | $50. | ○ | | | | | |
| AUG. | $40. | ○ | | | | | |
| SEPT. | $40. | ○ | | | | | |
| OCT. | $40. | ○ | | | | | |
| NOV. | $60. | ○ | | | | | |
| DEC. | $60. | ○ | | | | | |
| SUN. | $25. | ○ | | | | | |
| MON. | $15. | ○ | | | | | |
| TUE. | $15. | ○ | | | | | |
| WED. | $15. | ○ | | | | | |
| THUR. | $15. | ○ | | | | | |
| FRI. | $20. | ○ | | | | | |
| SAT. | $20. | ○ | | | | | |

METHOD OF PLAYING BOARD GAME

BACKGROUND OF THE INVENTION

1. Field of the Invention

The present invention relates to a board game device directed to young persons to teach them to think, reason and spend moneys earned themselves in a school setting.

2. Description of the Prior Art

A number of teaching board games have been available in the prior art areas of the board in accordance with the call of a die and game instructions. For example, U.S. Pat. No. 4,416,454 to Delamontagne discloses a business management teaching game that teaches players how to operate and manage a retail food store. Players are required to answer specific questions related to store management.

The game includes a gameboard having a first and a second player territory, a pair of player pieces, a pair of dice, a question booklet, a computer for indicating the correct answers to the questions posed in the question book, a score sheet for keeping cumulative totals of correct answers in each category and a predetermined amount of play money. Each player must answer questions in specific categories when his/her player piece resides on a position in his/her own territory. When a player's piece is located in a player position in the opponent's territory, the player must pay the opponent a certain amount of play money in proportion to the number of questions correctly answered by the opponent in the category of that particular player position. Moves of the player pieces are determined by a roll of the dice. Play is over when all the questions in all of the categories have been answered by both players. The winner is the one who obtains the greatest amount of play money.

This game disclosed in the '454 patent is relatively complex and appears to be directed to more mature players.

What is desired is to provide a simple board game designed for young players that demonstrates supply and demand concepts to educate people, particularly youngsters, on how to assume responsibilities, particularly those related to economics.

SUMMARY OF THE PRESENT INVENTION

A board game comprising a game board, games pieces, dice, score cards, score sheets, and play money. Before the game begins, one player will agree to represent the student store manager, and will keep an account of the flow of monies and properties between players.

At the beginning of the game, each player receives a check list, along with two twenty dollar bills, three ten dollar bills, three five dollar bills, four two dollar bills, and seven one dollar bills. The dice will then be rolled to determine the order of play. Players cannot swap, trade, or borrow monies or properties during game play; a player will not be allowed to purchase or sell to the student store. One trip around the board, during play is representative of a year, and will be broken down into twelve months, and will include properties, bills and expenses to be paid, and income to be made. A player may not purchase any properties unless he or she lands upon the appropriate space. Also, more than one player may occupy a space at once. Players may not purchase any properties the first time around the board; however, all expenses must be paid, at any time during the game. Each time a player passes the starting point, he or she will receive a $100.00 allowance, to get through another year. Months will be sold for $10.00 less than the purchase price, and weekdays are sold for $5.00 less than the purchase price. If during play, a player lands upon an "Event Card" space, that player must draw a card, and follow directions given. If a player rolls doubles, he or she may move, and then roll the dice again. The game continues until a player purchases all twelve months and all seven days, and becomes the winner.

The present invention thus provides a simple and inexpensive board game which teaches young players how to be responsible both in school and economic matters.

BRIEF DESCRIPTION OF THE DRAWINGS

For a better understanding of the invention as well as other objects and further features thereof, reference is made to the following description which is to be read in conjunction with the accompanying drawing wherein;

FIG. 1 is a plan view of the surface of the playing board of the present invention;

FIG. 2 is a perspective view illustrating a typical playing piece utilized in the present invention;

FIG. 3 is a perspective view of dice used in the present invention;

DESCRIPTION OF THE INVENTION

Figure 4:
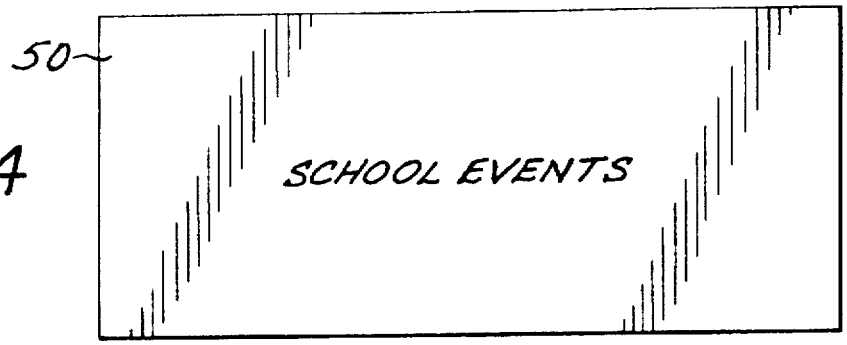
FIG. 4 illustrates a stack of School Events cards.

Referring now to FIG. 1, a plan view of the board game 10 of the present invention is illustrated.

The board has a plurality of spaces formed along the edges thereof, two areas 12 and 14 for receiving cards labeled School Events! and Dates and Events!, respectively, and four corner spaces 16, 18, 20 and 22. Corner space 16 is labeled "$50.00. May", space 18 is labeled "Educational Starting Point", space 20 labeled "$40.00. October" and space 22 is labeled "School Events". A first edge of the board is labeled "Library Lane Street' Quiet Zone!" and comprises eleven spaces 30, 32, 34 . . . 50, labeled, in sequence, "Dates and Events" "$40.00 April", "School Flower Expense Bouquets $5.00 Each", "$15.00 Monday", "$40.00March", "Dates and Events", "$50.00 February", "Dates and Events?", "$25.00 Sunday", "Movie Theater Expense Tickets $3.00 each" and "$50.00 January". A second edge of the board is labeled "Lunch Lane Sheet 'No Loafing'" and comprises twelve spaces 60 . . . 80, labeled in sequence "Pizza Parlor Expense, Pizzas $7.00 each", "Malt Shop Expenses, Malts and Shakes $3.00 each", "$60.00 December," "Popcorn Expense, Pop Corn $2.00 a bag", "Hot Dog Expense Hot Dog Plus Soda cost $4.00", "Lunch Area take a bread", "$20.00 Saturday", "Snack Stand expense Submarine Sandwiches $3.00 each", "$60.00 November", "Hamburger Stand Expense Hamburger plus Soda cost $4.00 each", and "School Events". A third edge of board 12 is labeled "School Lane Street 'No Speeding!'" comprises twelve spaces 90 . . . 110, labeled in sequence "Football Games Expense Tickets $5.00 each", "School Events !", "$20.00 Friday", "School Events !", "$40.00 September", "Basketball Games Expense Tickets $5.00 Each", "$15.00 Thursday", "$40.00 August", "School Events!," "$15.00 Wednesday" and "Baseball Games Expense Tickets $5.00 each". The fourth edge of board 12, labeled "Park Lane Street 'Slow Crossing'" comprises twelve spaces 120 . . . 140, labeled in sequence "Playground", "Balloon Stand Expense Balloon $2.00 each", "$50.00 July", "Cotton Candy Expense Cotton Candy Stand Expense Cotton Candy $2.00 a Cone", "$15.00 Tuesday", "Soda Stand Expense Sodas $1.00 each", "Water and Rest Area", "Flower Stand Expense $3.00 a bunch", "Fun and Games Expense $1.00 game", "$40.00 June", "Hat Stand Expense Hats $5.00 each" and "Ice Cream Stand Expense Ice Cream Sundaes $3.00 each".

Note that the dollar amount on the space is the amount of play money the player pays to the student store manager for purchasing the month/weekday on the space or the expenses listed.

The board game of the present invention is played as follows:

Players are not allow ed to swap, trade or borrow monies or properties from any other player. A player may only sell back properties that have been purchased by him or her to the student store where it was bought for $10.00 less than the purchase price.

The manager of the student store will keep an account of the monies that flow through the student store. A player may not purchase any properties, unless the player lands on the space.

More than one player may occupy the same space at the same time. If a player lands on one of the Event card spaces, that player is to move around the board as directed by the Event card. The Event cards are read by the player whose turn it is or may be assisted by any other person. The Event card is then given to the student store manager and held until all the cards have been pulled, the cards then being reshuffled by any one of the players.

Each time a player reaches the starting point where the game first started, the player received another year's allowance of $100.00 to get the player through another year. This allowance is received on a player's second time around the board. The players may not purchase any properties the first time around the board, but must pay all expenses called for. Two to four players may participate in this game. Each player is to receive their first year's allowance to start the game to reach their goal, i.e. two $20.00 bills, three $10.00 bills, three $5.00 bills, four $2.00 bills, seven $1.00 bills cash ($100.00 total). Each player gets to roll the dice to determine the order of play, the highest roller being first.

A player may not buy properties after the player's turn has finished. If a player rolls double dice, the player may continue to move. The game continues until one of the players has purchased all twelve months of the year, and all seven days of the week. The first player who purchases all twelve months plus the seven days of the week is automatically the winner or the last player to remain in the game with money is also considered to winner, whichever occurs first.

The game components comprise the game board 12, one set of standard dice, 45 twenty dollar money pieces, 50 ten dollar pieces, 55 five dollar pieces, 60 two dollar pieces and 65 one dollar pieces, 48 month of year cards, 28 days of the week cards, four play pieces (or tokens), and 80 Event Cards.

Regarding the cards, each date and event card have the heading of the month or date of the week that is being celebrated. Typical examples of such cards are as follows:

1. Move to Saturday the 7th day of the week. You are invited to the Saturday night social.
2. Move to the 2nd month of the year, February, to celebrate the first birthday of the first president of the United States.

Each School Events card sets forth the player's moves and money that is earned or expenses to be paid. Typical examples are:

1. You missed your doctor's appointment—go back 3 spaces.
2. You earned $20.00 extra for being a good helper.
3. Pay the student store $15.00 for the book you lost last year.

The cards are preferably made of a multitude of colors; the months and days cards are designed to be the same color as they occupy on the game board.

FIG. 2 is a perspective view illustrating a game piece, or token, 30 which may be utilized (the piece shown is shaped as a crown) by each player.

Figure 5:
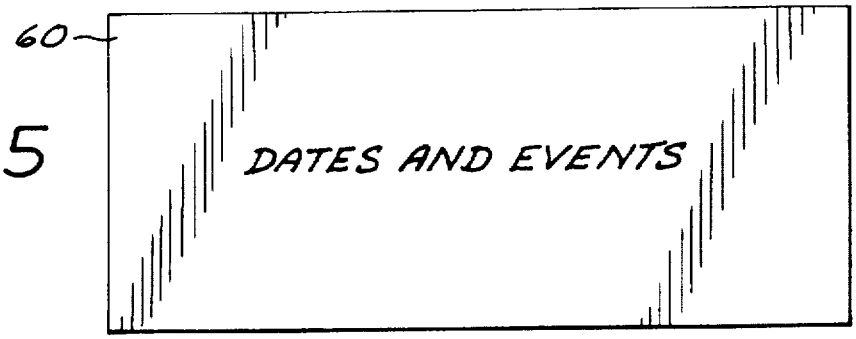
FIG. 5 illustrates a stack of Dates and Events cards.
Figure 6:
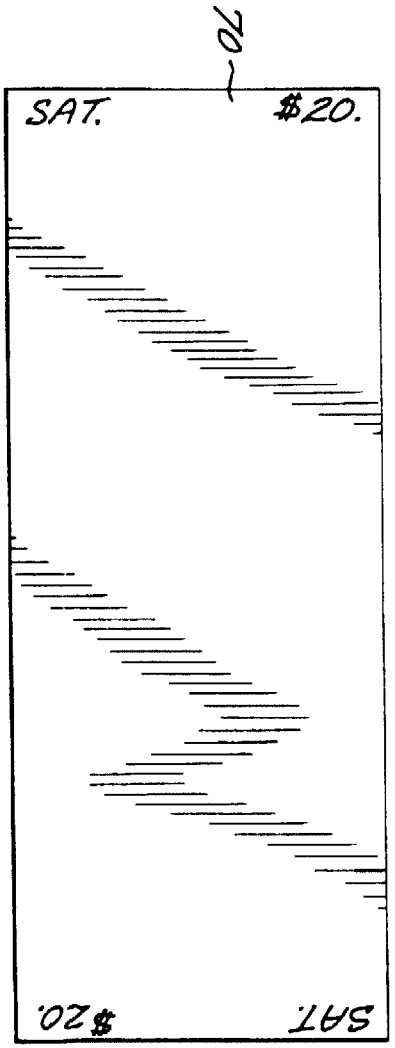
FIG. 6 illustrates ownership cards for the days of the week.
Figure 7:
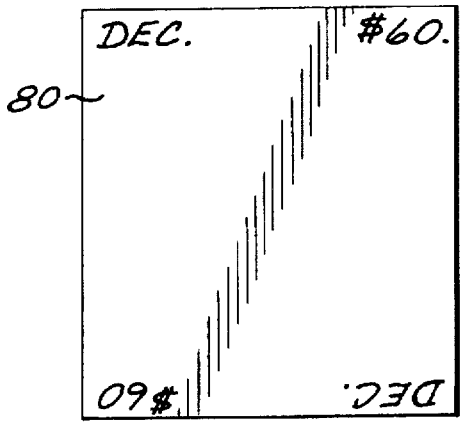
FIG. 7 illustrates ownership cards for the months of the year.
Figures 8, 9:
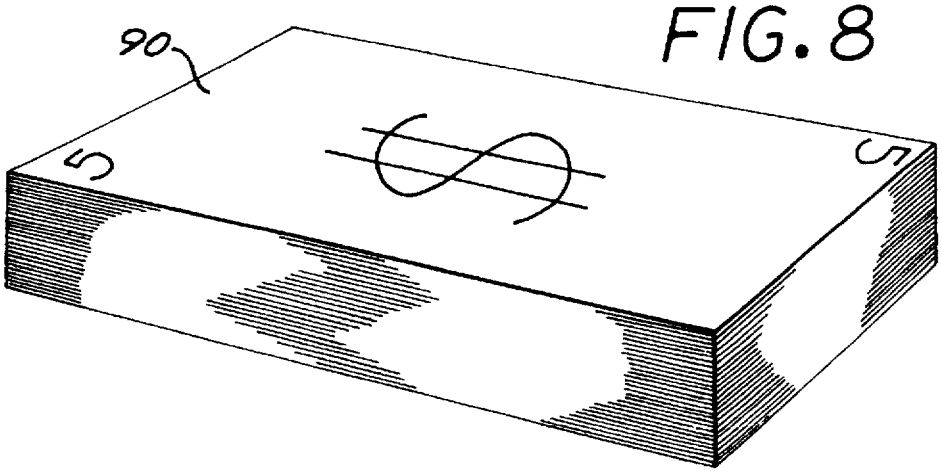
FIG. 8 illustrates a stack of play money.
FIG. 9 is a game score sheet.

FIG. 3 is a perspective view of dice 40 utilized in the game board of the present invention; FIG. 4 illustrates the top card 50 of a stack of School Events cards; FIG. 5 illustrates the top card 60 of a stack of Dates and Events cards; FIG. 6 illustrates the top card 70 of a stack of cards representing the ownership of the days of the week, card 70 representing the day Saturday at a sales price of $20; FIG. 7 illustrates the top card 80 of a stack of cards representing the ownership of the months of the year, card 80 representing the month of December at a sales price of $60; FIG. 8 illustrates a stack of money, the top bill representing $5; and FIG. 9 illustrates a game score sheet 100 having a list of the months of the year and the days of the week and spaces to indicate whether the particular property is owned or has been sold and the prices realized thereby.

While the invention has been described with reference to its preferred embodiment, it will be understood by those skilled in the art that various changes may be made and equivalents may be substituted for elements thereof without departing from the true spirit and scope of the invention. In addition, modifications may be made to adapt a particular situation or material to the teachings of the invention without departing from its essential teachings.

What is claimed is:

1. A method of playing a board game directed to teaching children values, the board game having a playing board and playing area comprising the steps of:

dividing said playing area into a plurality of spaces along the edges of said board; certain of said spaces having instruction indicia thereon defining the expenses or income to be paid or received from a playing piece landing thereon, the player then paying expenses or receiving income in accordance with the instruction;

placing a plurality of playing pieces initially in predetermined ones of said spaces for a first and second player;

distributing a predetermined amount of play money to each player at the beginning of the game;

moving a playing piece a number of spaces according to the roll of a dice, the spaces being divided into months and weekdays each of which are available for purchase, spaces also including bills and expenses to be paid and income to be received; and rolling a die to determine the total number of spaces the playing pieces are to be moved in each turn of play, the first player purchasing all twelve months and all seven days being declared the winner.

2. The method of claim 1 wherein certain of said indicia directs the player landing thereon to select a card from one stack of a plurality of card stacks.

3. The method of claim 2 wherein the cards in said first stack of cards directs the player to move to a particular space having a month or day labeled thereon.

4. The method of claim 3 wherein the cards in said second stack of cards direct the player to move to a particular space wherein the player is awarded income.

5. The method of claim 4 wherein the cards in said second stack of cards direct the player to move to a particular space wherein the player is charged expenses.

* * * * *

UNITED STATES PATENT AND TRADEMARK OFFICE

CERTIFICATE OF CORRECTION

PATENT NO : 5,799,942

DATED : September 1, 1998

INVENTOR(S) : Frances B. Birt

It is certified that error appears in the above-identified patent and that said Letters Patent is hereby corrected as shown below:

Title page item [57],
In the abstract, line 8,delete "not" and insert

--only-- therefor.

In column 1, line 54, delete "not" and insert

--only-- therefor.

Signed and Sealed this

Twenty-ninth Day of February, 2000

*Attest:*

Q. TODD DICKINSON

*Attesting Officer*

*Commissioner of Patents and Trademarks*